US007111658B1

(12) United States Patent
Hanna

(10) Patent No.: US 7,111,658 B1
(45) Date of Patent: Sep. 26, 2006

(54) LOCKING MECHANISM

(76) Inventor: John E. Hanna, 4313 Fairlane, Acton, CA (US) 93510

( * ) Notice: Subject to any disclaimer, the term of this patent is extended or adjusted under 35 U.S.C. 154(b) by 0 days.

(21) Appl. No.: 10/928,946

(22) Filed: Aug. 27, 2004

(51) Int. Cl.
*E04F 10/06* (2006.01)

(52) U.S. Cl. ..... 160/67; 160/304.1

(58) Field of Classification Search ..... 160/22, 160/66, 67, 303, 304.1; 135/88.11, 88.12; 292/150
See application file for complete search history.

(56) References Cited

U.S. PATENT DOCUMENTS 1,597,837 A * 8/1926 Staley ..... 292/57
1,942,219 A * 1/1934 Segal ..... 292/251
4,179,143 A * 12/1979 Shy ..... 292/179
4,705,148 A * 11/1987 Zindler ..... 192/223
4,770,223 A * 9/1988 Ouellette ..... 160/302
4,819,706 A * 4/1989 Quinn ..... 160/67
5,242,003 A * 9/1993 Pozzi ..... 160/22
6,089,306 A * 7/2000 Frey, Jr. ..... 160/302
6,792,993 B1 * 9/2004 Forbes ..... 160/67

* cited by examiner

*Primary Examiner*—David Purol

(57) ABSTRACT

A locking mechanism (20) for locking a roller-tube (30) in its assembly (22), such as found in awning contraptions mounted on RV and other motor vehicles (34). A shaft (42) slides to-and-fro in its bore (44) extending between end walls (35, 36) of a body (33). A collar (49) at one end of shaft (42) captures the latter's motion at one end (50) of body (33). Another collar (53) disposed on shaft (42) along its length projecting beyond the opposite end (54) of body (33) also prevents escape of shaft (42) from body (33) in its other direction. Collars (49, 53) function to limit the sliding of shaft (42) back and forth as a hooking wand is applied to one or the other. A pin (59) in detent (60) seats in body (33) from its bottom wall (38) to engage a point or annular groove (55) in shaft (42) to maintain a length of a portion (47) in an elongated length (46) in shaft (42) so that portion (47) of shaft (42) engages a stop or peg (74) on the periphery (82) of an end cap (72) of roller-tube (30) to immobilize roller tube (30) from rotating. Threaded holes (67) are provided on back wall (39) of body (33) for mounting mechanism (20) to a support arm (28) to which roller-tube assembly (22) is connected.

7 Claims, 5 Drawing Sheets

LOCKING MECHANISM

TECHNICAL FIELD

This invention is directed to a locking mechanism by which an awning or other material is retained in a rolled-up condition in a roller-tube, and in particular, to a mechanism for a roller-tube awning assembly adapted for mounting to and in combination with an outside panel of an RV (recreational vehicle), other motor vehicles, or in general to a panel which mounts such an assembly and having need for immobilizing rotation of the roller tube of its assembly and its awning or other rollable material within the roller tube.

BACKGROUND TO THE INVENTION

Awnings in roller-tube assemblies mounted to outside panels of RV and other vehicles tend to unroll or unravel as the vehicles travel along roadways by reason of its tube tending to rotate. Repair or replacement of the awnings are frequently necessary, and there are repetitive efforts requiring labor, expenditures for purchase and for repair. There is a need to retain the awnings in immobile roller-tubes under such traveling conditions, as the subject matter of this invention achieves.

SUMMARY OF THE INVENTION

The invention is directed to a locking mechanism and its combination with a roller tube to maintain the latter in an immobile condition. A shaft slidably fit to a body includes an elongated length in which a portion of the elongated length functions to prevent the roller tube from rotating. A detent seated in the body acts on a point or annular groove formed in the shaft within the body to lock the portion of the elongated length in a position from the body at which it functions to abut a stop lock or peg secured to an end cap of the roller tube. By an easy release of the detent from its annular groove by sliding the shaft in a direction away from the end cap, the roller tube no longer is immobile and can rotate in operation of opening its awning into its aproned extant. Collars are fixedly provided along or on the shaft exterior of opposing walls of the body through which the shaft projects, to limit its sliding movement between its immobilizing function on the roller tube and the mechanism's unlocked mode at which the roller tube is free to rotate.

An object of this invention is to provide a locking mechanism for a roller-tube assembly to immobilize its roller tube from turning, especially in the travel condition for its roller-tube assembly.

Another object of this invention is to fully retain an awning or the like within its roller tube during the travel condition for the roller-tube assembly.

A still further object of this invention is to provide a locking mechanism at a reasonable or much less expensive cost for easy application to a roller-tube assembly.

Yet another object of this invention is to provide for a locking mechanism that can be applied to its installation in a simple, relatively quick, and expedient manner, with much reduction in labor during its installation.

These and other objects of the invention will become more apparent by a full and complete reading of the following description, its appended claims and the accompanying drawing comprising four (4) sheets of nine (9) FIGURES.

BEST MODE FOR CARRYING OUT THE INVENTION

Figure 1:
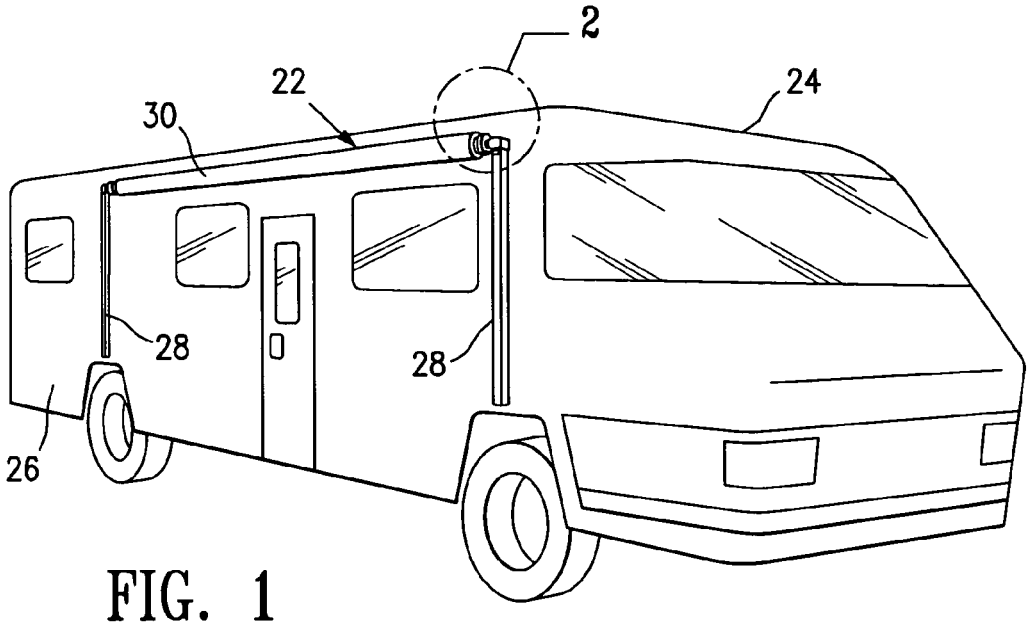
FIG. 1 is a perspective view of a (side) panel on an RV or other motor vehicle to which the subject matter of this invention is mounted it being shown mounted to the vehicle's roller-tube awning assembly.

Referring now to the drawing FIGURES wherein reference characters correspond to like numerals hereinafter, the invention is found in a locking mechanism 20 and its application to a roller-tube assembly such as found in an awning roller-tube assembly 22 associated with RV and other motor vehicles 24 on which roller-tube awning assemblies for various reasons are desired. Locking mechanism 20 need not be applied only to an assembly 22 on a panel 26 on RV and other motor vehicles 24 but has application to other assemblies that require mechanism 20 for operation between locked and unlocked modes in its operation.

Figure 2:
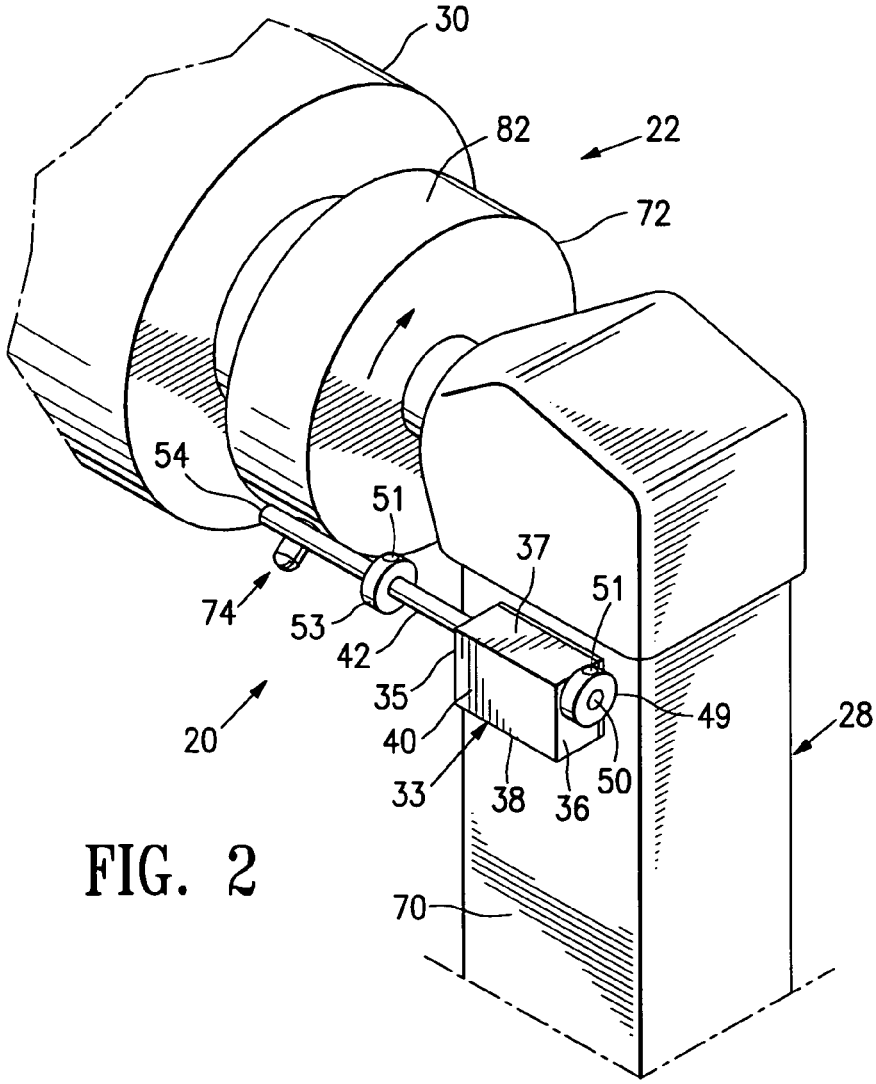
FIG. 2 is an enlarged fragmentary perspective view of the circled segment illustrated in FIG. 1, showing the locking mechanism in its lock mode upon the roller-tube of an awning's assembly.
Figure 9:
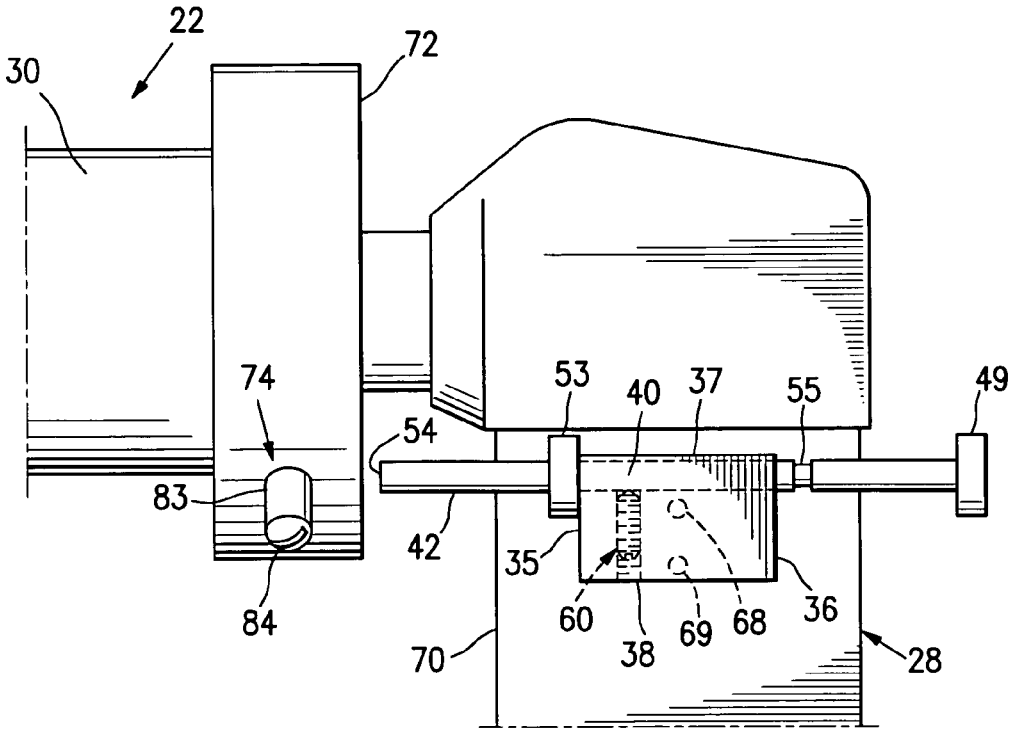
FIG. 9 is an elevational view like that of FIG. 4 but with the locking mechanism shown in its unlocked mode.

FIGS. 1 and 2 illustrate a motor-vehicle environment in which the invention finds application. Motor vehicle 24 has mounted on its side panel 26 an awning roller-tube assembly 22 that can extend outwardly of panel 26 by means of its pair of main support arms 28 pivoting outwardly of panel 26 in conventional or known manner, the awning unraveling into its opened apron through a slot (not visible) formed in its roller-tube 30 as the latter is carried in the pivoting of arms 28 to the open-apron position for the awning. It is not necessary that awning and operation of the main support arms 28, conventional in the industry, be illustrated as part of this invention as practice of the invention is limited to the locking and unlocking modes of mechanism 20 in its installed position on one of the main arms 28 supporting assembly 22. Operation of locking mechanism 20 upon roller-tube 30 occurs only when the latter is in its closed or non-opened condition. FIGS. 2, 4, 5, and 7 illustrate the disposition of locking mechanism 20 as applied to awning roller-tube assembly 22 so that its awning is retained in its rolled-up condition within roller tube 30. FIG. 9 illustrates the disposition of locking mechanism 20, securely mounted to its support arm 28, in its unlocked mode for roller-tube assembly 22 and by which the latter's awning is free to unravel from its roller-tube 30 as both support arms 28 pivot into their extended pivoted position (not illustrated).

Figure 5:
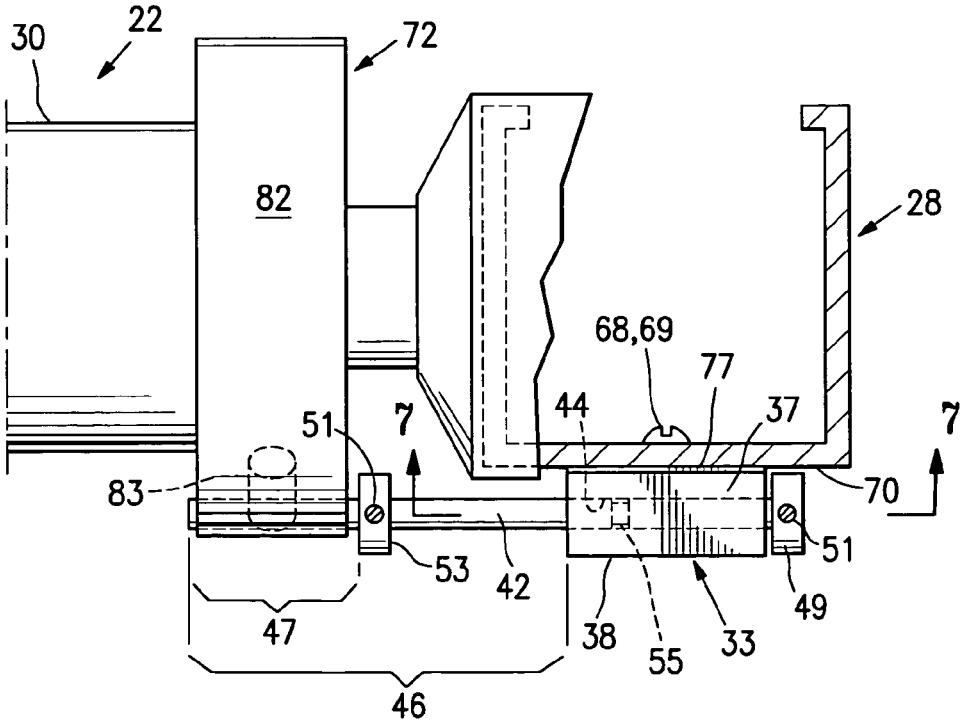
FIG. 5 is a plan view, partially broken away, of FIG. 4.

Locking mechanism 20 is configured in a body 33, FIG. 5, preferably of linear configuration or dimensions, as in a block, of suitable material, such as stainless steel, and of suitable size commensurate with the size of a supporting arm 28 to which it is to be securely mounted. Body 33 includes opposing end walls 35, 36 joined together by a top wall 37, a bottom wall 38 and side walls 39, 40. A shaft 42 slidably moves in both directions, as it is displaced in operation, within a slip-fit bore 44 provided in body 33 and extending between opposing walls 35, 36. Preferably bore 44 is located adjacent to and in general parallel alignment with top wall 37. Shaft 42 includes an elongated length 46 projecting past the one opposing wall 35 and which includes a portion 47 of its length that functions to prevent rotation of roller tube 30 in its assembly 22. A collar 49 is fixed to shaft 42, at its one end 50 preferably, end 50 when adjacent to the one opposing wall 36 limiting the sliding movement of shaft 42 in its direction of movement towards opposing wall 35. Collar 49 is fixed to shaft 42 by means of a conventional set screw 51 in its bore (not visible) extending radially inwardly of the thickness of collar 49 to bite against shaft 42. Another collar 53 is fixed to shaft 42 in the same manner as that of set screw 51 in collar 49, along elongated length 46 of shaft 42 exteriorly of opposing wall 35. A portion 47 of elongated length 46 is located outwardly of collar 53, preferably in proximity to the other end 54 of shaft 42. Sliding movement of shaft 42 in a direction towards opposing wall 36 is limited or halted by collar 53 abutting opposing wall 35 as shaft 42 slides in a direction towards opposing wall 36.

The diameter of shaft 42, in the preferred embodiment illustrated, forms, at a particular point generally midway the distance between collars 49, 53, an annular groove 55 in shaft 42. A pin 59, FIG. 7, of a detent 60 is spring-biased to advance into such point or annular groove 55 as shaft 42 slides in the direction of its length of portion 47 along elongated length 46. With such action of detent 60 upon shaft 42, portion 47 of elongated length 46 of shaft 42 is in its extended location to immobilize the tube 30 of assembly 22. Detent 60 seats in a threaded bore 61 extending inwardly from bottom wall 38 of body 33, the detent 60 itself being formed by a threaded head 62 that cooperates with its threaded bore 61, a hollow chamber 63 being formed in head 62 for the seating of a spring 64 and detent pin 59 that is held in place by a nut 65 or the like. A slot 66 in the head 62 provides for an expedient way to fasten detent 60 in place in bore 61.

Figure 8:
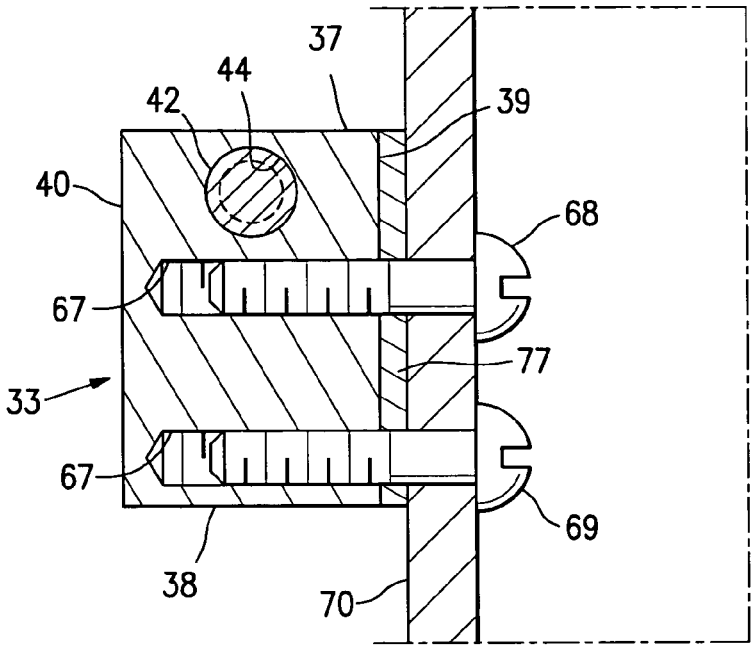
FIG. 8 is a view taken on line 8—8 of FIG. 4.

A pair of spaced threaded holes 67, FIG. 8, are formed in the one side or back wall 39 of body 33, so that a pair of threaded screws 68, 69 can attach body 33, and thus able to securely mount mechanism 20, to a front member 70 forming support member or arm 28. It is to be noted that the forming of holes 67 do not interfere with the shaft's bore 44 or with bore 61 in which detent 60 is disposed, nor do bores 44 and 61 interfere with each other.

Figure 6:
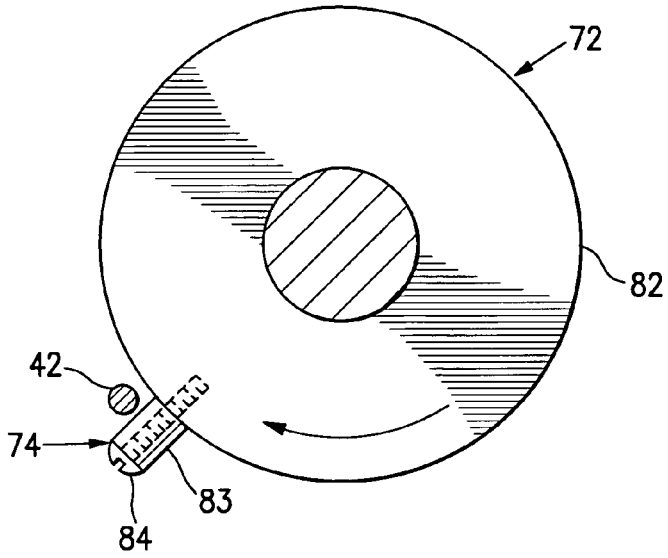
FIG. 6 is a view taken on line 6—6 of FIG. 4.
Figure 7:
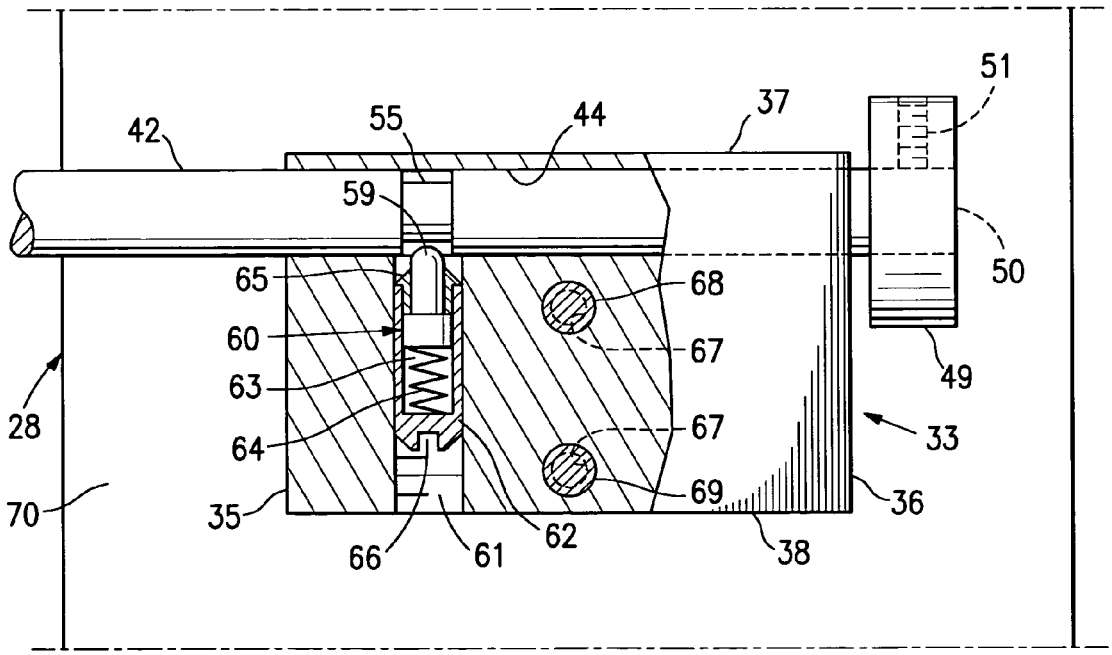
FIG. 7 is a view taken on line 7—7 of FIG. 5.

In operation of locking mechanism 20, by which roller tube 30 is immobilized, thus retaining the assembly's awning within it, with roller-tube 30 in its travel position for assembly 22, the hook on a pull-rod or wand (not shown yet well known to RV and other motorists for opening an awning assembly on a panel 26 when in a non-travel position for the roller-tube) engages collar 49, simply pushing or sliding shaft 42 towards an end cap 72 on roller tube 30. Detent 60 engages the point or annular groove 55 in the sliding action of shaft 42 at which the length of portion 47 on the elongated length 46 of shaft 42 has passed below or under a peg or "stop lock" 74 securely mounted to end cap 72, and against which the length of portion 47 stop lock 74 is to abut. Consequently, roller tube 30 and its end cap 72 do not rotate in the direction illustrated by the arrow in FIG. 6, so that the awning cannot unravel through its slot (not visible in its roller-tube 30) as the length of portion 47 and the peg 74 engage each other. To unlock roller-tube 30 from its immobilized condition so that it and its awning, respectively, can rotate and unroll, the hook of the pull rod engages collar 53 and pushes it towards body 33 thereby releasing length of portion 47 of shaft 42 from abutting peg 74 in end cap 72.

In assembly of locking mechanism 20, with completed fabrication of body 33 and its bores, shaft 42 with its annular groove 55, collars 49, 53 with their set screws 51, and the components of detent 60, shaft 42 is slip-fit to its bore 44 in body 33, and collars 49, 53 are fit to shaft 42 and firmly set in their fixed positions on shaft 42 by tightening of their respective set-screws. Spring-biased detent 60 is in itself assembled and then threaded into its bore 61.

Figure 3:
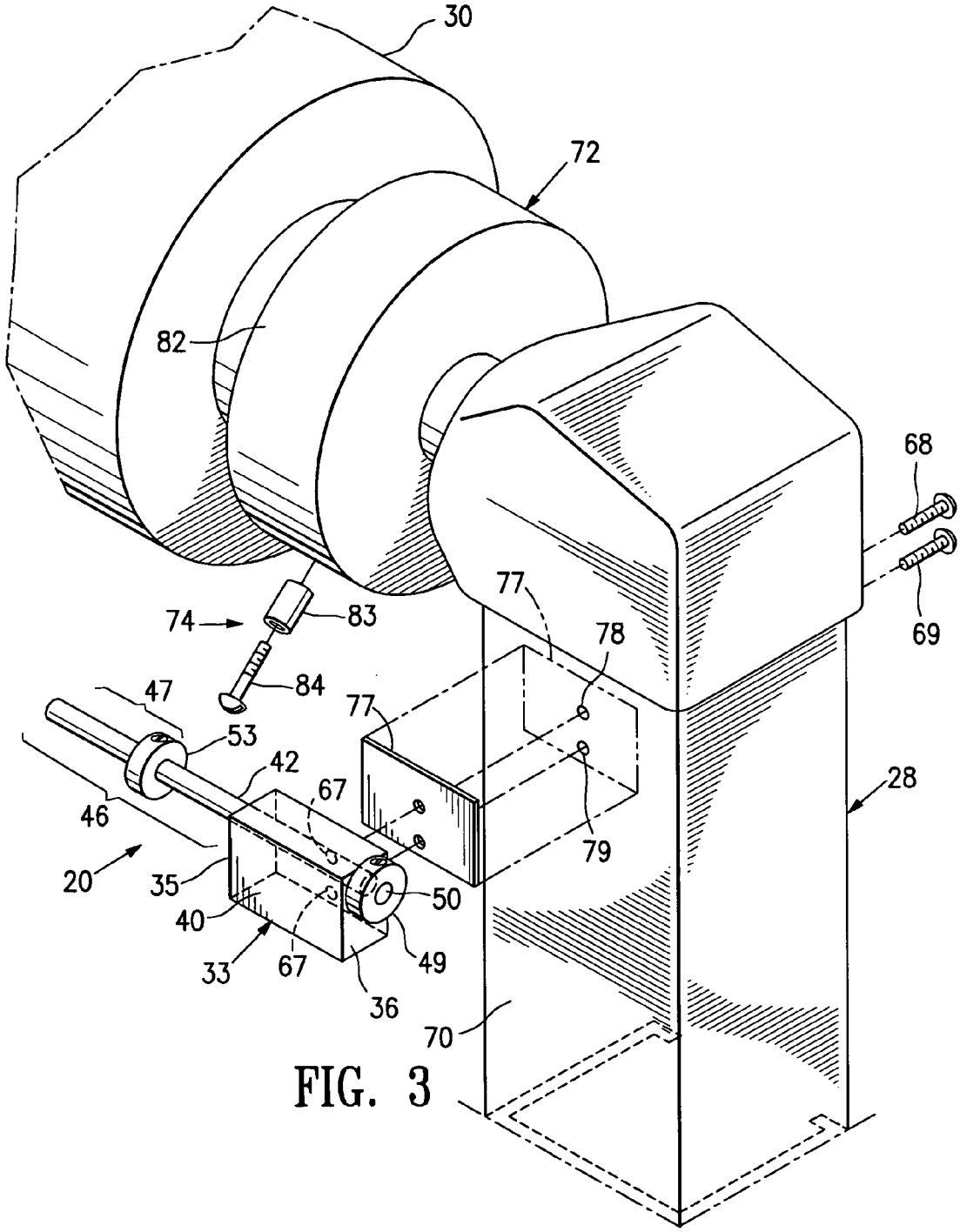
FIG. 3 is an exploded enlarged fragmentary perspective view of the enlarged FIG. 2 illustration, with the locking mechanism in an assembled disposition prior to mounting it to a supporting arm for a roller-tube of an awning's assembly.
Figure 4:
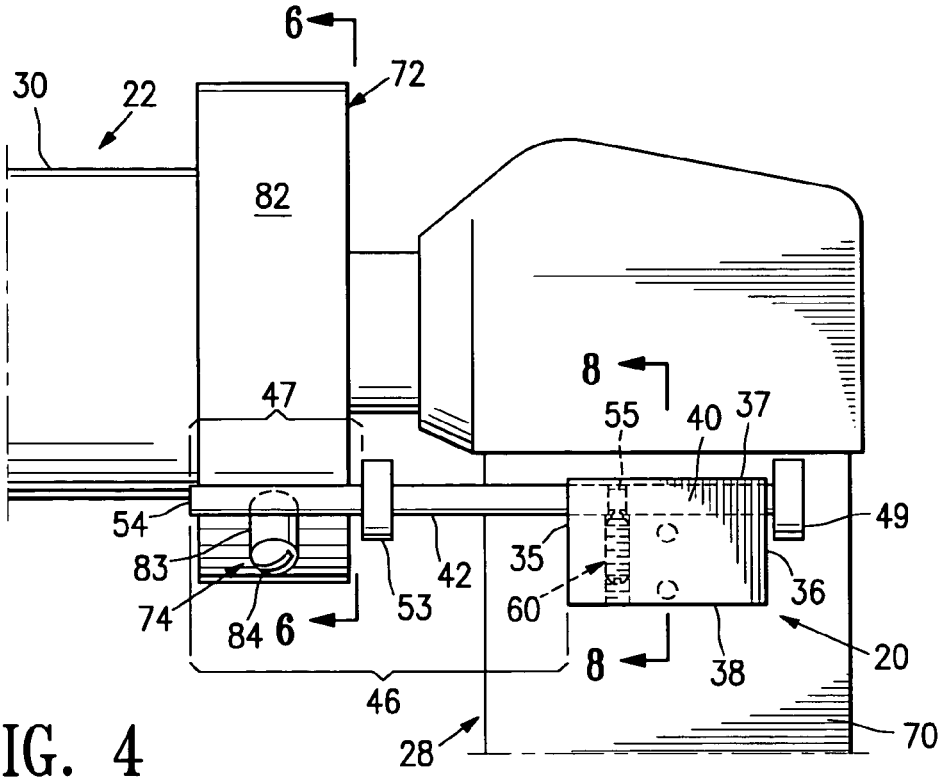
FIG. 4 is an elevational view of the FIG. 2 illustration.

Installation of locking mechanism 20 and peg 74 to supporting arm 28 and end cap 72, respectively, is illustrated in FIGS. 2, 3, 5, and 8. The size of back wall 39 of body 33 is outlined on front wall 70 after which an adhering template 77, earmarked in print with an outline of holes thereon, is fastened to front wall 70. The print of holes is center-punched and holes 78, 79 in front wall 70 of arm 28 are formed through template 77 with a conventional drill bit. Screws 68, 69, FIGS. 3 and 8, are threaded to the threaded holes 67 in back wall 39 of body 33, from inside of front wall 70, through holes 78, 79.

With a retraction condition of the awning in its roller tube 30 in its travel condition for assembly 22, in which the length of portion 47 on shaft 42 has first been positioned under or past end cap 72, a hole (not visible) is radially drilled in the periphery 82 of end cap 72 above the positioned portion 47. A hollow sleeve 83 is mounted to a stainless steel thread-cutting machine screw 84 after which screw 84 is threaded to the hole in periphery 82 thereby producing a "stop lock" on end cap 72 for roller tube 30.

It is pointed out that in some commercially available roller-tube assemblies 22 that a gearing arrangement (not visible) may be located within, say, some of the space under end cap 72. So the drilling of the hole in periphery 82 of end cap 72 should not occur in alignment with the plane of such gearing arrangement in order to prevent interference with it.

The materials of locking mechanism 20 are preferably stainless steel although other suitable metal and other suitable materials may be found to be useful for it and its components or elements.

Various changes and modifications may be made in the subject matter of this invention without varying or departing from the scope or spirit of the invention. Although the invention has been generated with awning roller-tube assemblies 22 in mind, locking mechanism 20 may also be applicable in other industrial application contexts. Body 33 need not be a solid as illustrated. Collars 49, 53 need not be duplicates of each other, and may also be of different sizes from each other, as long as they prevent escape of shaft 42 from body 33 should they be included in an embodiment of the invention. One or both collars 49, 53 are not necessary to the operation of the invention, as shaft 42 may be shifted manually to-and-fro exteriorly of its opposing walls 35, 36, however, as roller-tube assembly 22 is usually positioned at a relatively higher level than that of a human operator, application of the awning rod or wand (not illustrated) to the collars 49, 53 provides for a quick manipulation of shaft 42 in one direction or the other, with collars 49, 53 functioning to prevent escape of shaft 42 from body 33 in one or the other of directions in which it can slide. Top wall 37 may also be the bottom wall 38 in reverse of configuration of body 33. Means other than the detent 60 illustrated in the drawing is contemplated within the inventive concept in which shaft 42 can be fixedly positioned to immobilize roller tube 30.

INDUSTRIAL APPKICABILITY

The invention is applicable to the RV motor vehicle industry, although it has application in other industries in which locking mechanism 20 is required to immobilize or prevent rotation of a rotatable element.

I claim:

1. A locking mechanism in combination with a tube's assembly for immobilizing said assembly and which results from its sliding motion from an unlocked mode to its locked mode, said locking mechanism comprising a body having a first bore between opposing walls in said body, a shaft slidably movable in the first bore and having a length extending beyond one of said opposing walls such extended length including a portion of length by which the tube's assembly is caused to be immobilized, said shaft including a point therealong within said body, means in said body for engaging said shaft in its sliding motion to lock said shaft at said point and by which locking said shaft's extended length is prepared to immobilize the tube's assembly, said shaft locked from moving by said engaging means in the immobilized condition for the tube assembly, said tube's assembly having a tube and a member supporting said tube, said tube assembly including a stop means, and means for securely mounting said locking mechanism to said member, whereby upon the locking of said shaft said stop means abuts said portion of length of said shaft's extended length for preventing mobilization of said tube assembly.

2. In the combination of claim 1, said locking mechanism including means on said shaft exteriorly of said body for preventing said shaft from escaping from said first bore in its sliding motion.

3. In the locking mechanism of claim 2, said preventing means takes the form of spaced collars securely mounted to said shaft.

4. The combination of claim 3 wherein said preventing means comprises at least one collar securely mounted on the extended length of said shaft.

5. In the locking mechanism of claim 3, one of said collars is fixedly mounted along the elongated length of said shaft and the other of said collars is securely mounted on said shaft exteriorly of said body beyond the other of said opposing walls.

6. The locking mechanism of claim 1, wherein said body is formed in a solid linear configuration, said first bore and said shaft extending in proximity to and along a top linear wall of said configuration, said engaging means seated in a second bore formed inwardly from a linear bottom wall of said body, said mounting means formed in a linear side wall of said body, said first bore and said second bore in non-interference manner with said mounting means in said configuration.

7. The combination of claim 1 wherein said tube is a roller-tube for an awning, and said stop means is securely mounted to a cap on said roller-tube in said assembly, whereby upon engagement of said engaging means with said point the portion of length on said elongated length of said shaft abuts said stop means to immobilize said roller-tube.

* * * * *